United States Patent [19]

Siegal

[11] 4,446,669

[45] May 8, 1984

[54] END CHANNEL MEMBER FOR SPACE DIVIDING SYSTEM PANEL

[75] Inventor: Burton L. Siegal, Skokie, Ill.

[73] Assignee: Acme Steel Door Corp., Brooklyn, N.Y.

[21] Appl. No.: 192,541

[22] Filed: Sep. 30, 1980

[51] Int. Cl.[3] ..... A47B 57/16

[52] U.S. Cl. ..... 52/738; 52/36; 52/239; 160/135; 211/134

[58] Field of Search ..... 52/36, 239, 738; 160/135; 211/134

[56] References Cited

U.S. PATENT DOCUMENTS

| | | | |
|---|---|---|---|
| 3,668,827 | 6/1972 | Schwartz | 52/36 |
| 3,700,385 | 10/1972 | Sherwaad | 52/239 |
| 3,778,939 | 12/1973 | Nelsson | 52/36 |
| 3,828,495 | 8/1974 | Law | 52/36 |
| 3,971,182 | 7/1976 | Donahue | 160/135 |
| 4,021,973 | 5/1977 | Hegg | 52/36 |
| 4,047,342 | 9/1977 | Boulva | 52/239 |
| 4,129,163 | 12/1978 | Johnson | 52/239 |

FOREIGN PATENT DOCUMENTS

| | | | |
|---|---|---|---|
| 2262900 | 6/1973 | Fed. Rep. of Germany | 160/135 |
| 2060022 | 4/1981 | United Kingdom | 52/239 |

*Primary Examiner*—Henry E. Raduazo

*Attorney, Agent, or Firm*—Kane, Dalsimer, Kane, Sullivan & Kurucz

[57] ABSTRACT

An end channel member for office space dividing panels is provided. In section, the channel member includes a portion containing a vertical array of slots for receiving a bracket hook. The slotted portion is contained at the base of a recess with the surfaces defining the sides of the recess serving to capture the bracket hook and thereby prevent it from swaying from side-to-side. The longitudinal ends of the channel include post clips at least one of which is free to float to some extend so as to facilitate installation.

3 Claims, 3 Drawing Figures

END CHANNEL MEMBER FOR SPACE DIVIDING SYSTEM PANEL

BACKGROUND OF THE INVENTION

The present invention relates to space dividing systems and more particularly to an improved end channel for space dividing panels.

The use of space dividing panels is enjoying increased popularity in the modern planning of interior office space. The panels may readily be moved and rearranged so that the office space is not confined to any particular configuration but may readily be rearranged as needs change. The use of such interior panels to divide an office space into allocated areas is commonly called "office landscaping".

Heretofore a multitude of systems have been developed for office landscaping. For the most part, these prior art systems provide for framed panel members to be interconnected to connector posts. Typical systems and components are disclosed in U.S. Pat. Nos. 3,762,116 and 3,877,191.

The panels come in various heights depending upon the uses of the enclosure they are to form. In some instances, relatively low panels 4 or 5 feet high, are desireable to enable workers to see over the panels into adjacent areas. In other installations, relatively tall panels, on the order of six or more feet may be required to provide relative privacy within the enclosed space.

The sides of the panel frame are formed of extruded aluminum channel members provided with vertical perforations from which shelves, cabinets, light fixtures or the like may be hung utilizing hook brackets such as shown in the aforementioned U.S. Pat. No. 3,887,191. In order to prevent the article being hung from swaying from side-to-side, it has heretofore been common to secure the article being mounted directly to the bracket in the manner shown in the aforementioned patent. While this serves to effectively stop swaying, it makes installation difficult particularly where the article being installed is a heavy cabinet. This arrangement poses special problems where two panels are arranged perpendicular to each other. In this case, the installer has very little room in which to manipulate the bracket and the possibility exists that the bracket may accidentally scratch or mar the adjacent panel during installation.

Another problem encountered with the office landscaping systems heretofore available stems from the fact that the height of the panels makes handling and installation difficult. This is particularly so with respect to connecting the panel to a support post since the clearance on the support post is generally on the order of a fraction of an inch.

In view of the above, it is a principal object of the present invention to provide an improved end channel for space dividing panels which is so designed as to prevent sway of an associated bracket.

A further object is to provide an end channel which may more readily be attached to its associated support post than has heretofore been possible.

A still further object is to provide an end channel which is esthetically pleasing and compatible with existing panels and other office landscaping components.

Still further objects and advantages will become apparent from the following description of the invention.

SUMMARY OF THE INVENTION

The above and other beneficial objects and advantages are attained in accordance with the present invention by providing an improved end channel for area dividing panels. The end channel comprises an elongated member having a central web section substantially equal in width to the thickness of an associated panel. The transverse ends of the web are each formed into a pair of recesses at each end, one of said recesses is defined by a pair of spaced apart surfaces extending perpendicular to the plane of the web section and a base extending parallel to the web section. The other recess is defined by a pair of surfaces extending parallel to the plane of the web, a base extending perpendicular to the web. The last mentioned parallel surfaces are spaced apart a distance equal to the width of an associated bracket hook and a plurality of bracket hook slots are disposed in the recess base.

Clips for mounting the channel to a support post are secured to the ends of the channel member. At least one of the clips is mounted to the channel with a "sloppy" fit to permit some longitudinal shifting.

DETAILED DESCRIPTION OF THE PREFERRED EMBODIMENT

Figure 1:
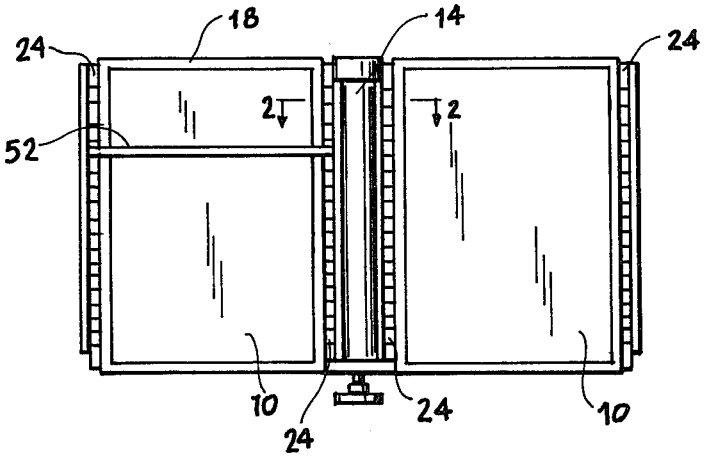
FIG. 1 is a simplified front elevational view of a space dividing system utilizing an end channel member in accordance with the present invention.

Reference is now made to the drawings and to FIG. 1 in particular wherein a pair of space dividing panels 10 are shown on opposite sides of a connecting post 14. Each panel consists of spaced outer sheets 16 formed of sheet steel or the like and covered with a decorative surface material or suitably painted. The outer sheets 16 are separated by a suitable filler material 20. The panels are contained within a metallic frame 18 consisting of top and bottom members 22, side members 24 which comprise the panel end channel members of the present invention.

Figure 2:
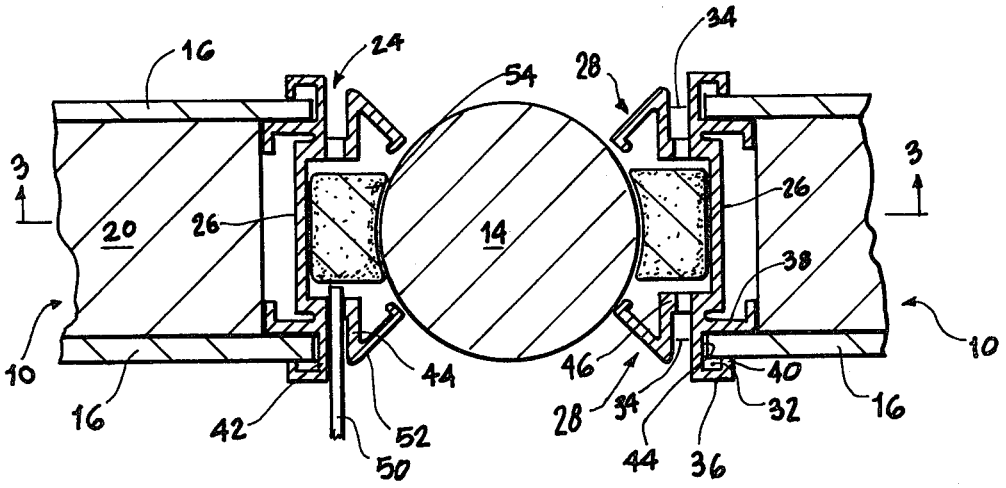
FIG. 2 is a fragmentary sectional view taken along reference lines 2—2 of FIG. 1 in the direction of the arrows; and, FIG. 3 is a fragmentary sectional view taken along reference lines 3—3 of FIG. 2 in the direction of the arrows.

Each channel member 24 comprises an elongated extruded aluminum strip coextensive in length with its associated panel. As shown in FIG. 2 (wherein two identical end channels 24 are depicted on opposite sides of post 14) in section the end channel 24 is symmetrical about the middle of web 26 and consists essentially of the web 26 and the end sections 28 to be discussed. Each end 28 of the web 26 is shaped to define two mutually perpendicular pockets or recesses 32 and 34. The first recess 32 is defined by two surfaces 36 and 38 which extend perpendicular to the web 26 and are spaced apart from each other a distance sufficient to receive the panel outer sheet member 16. An in-turned lip 40 at the free end of surface 36 insures a tight engagement with sheet 16. The bottom 42 of recess 32 comprises and offset extension of web 26 as shown.

Figure 3:
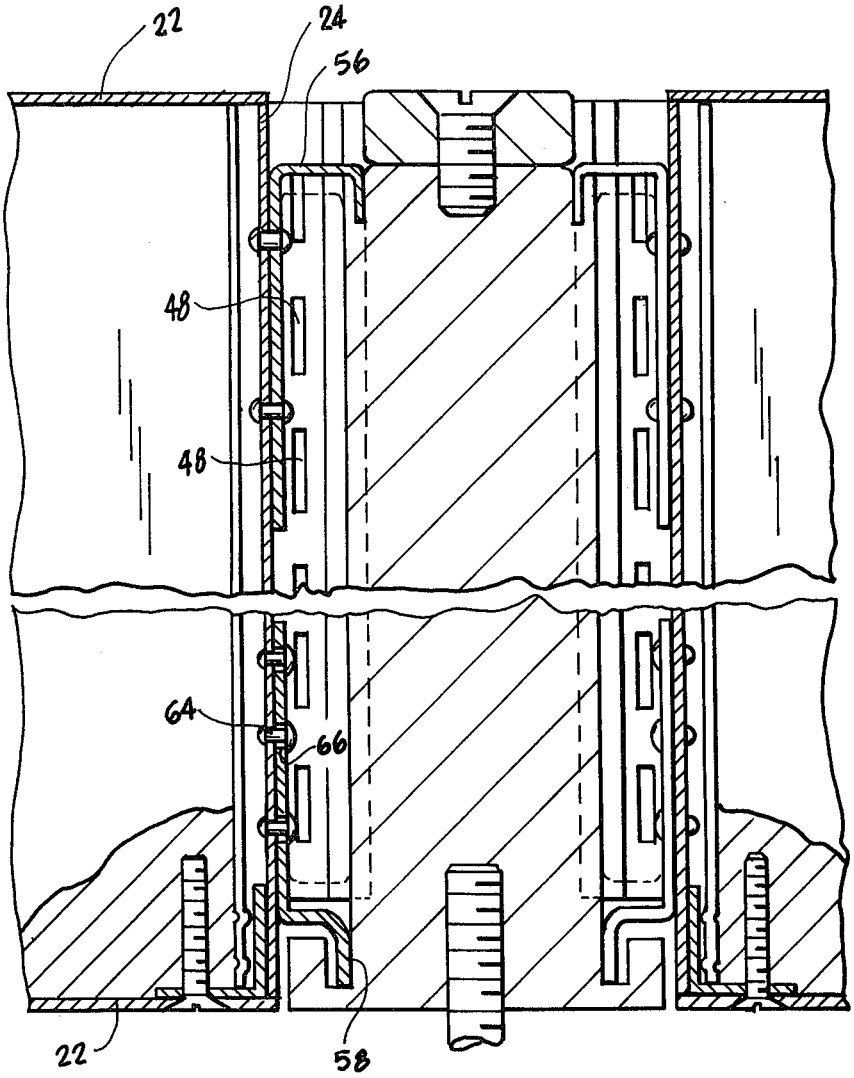

The second recess 34 is defined by surface 42 (i.e. the bottom of recess 32) and a spaced apart parallel surface 44. Surfaces 42 and 44 both extend parallel to web 26 as shown. The bottom 46 of recess 34 extends perpendicular to the plane of web 26 in the direction opposite to that from which surfaces 36 and 38 extend. The bottom portion 46 of recess 34 is provided with a series of regularly spaced apart slots 48 which extend longitudinally for the entire length of member 24 as shown in FIG. 3. Slots 48 serve to receive and hold a bracket hook 50 which, in turn, may be used to mount a shelf 52 or other accessories to the panel 10 in a manner well know.

It should be noted that in accordance with the present invention, a portion of the bracket hook 50 is captured between surfaces 42 and 44 of recess 34 as shown in FIG. 2. By thus capturing the bracket hook, the bracket is prevented from swaying from side-to-side.

Referring still to FIG. 2, it should also be noted that each surface 44 of recess 34 terminates at its free end in a wing 52 which extends at an angle of 45° with respect to the web 26. The web 26 extends perpendicular to the plane of outer sheet 16 and the channel member 24 and particularly the wings 52 are proportioned so that four members (only two of which are shown in FIG. 2) can fit about a circular post 14 spaced 90° apart from each other.

In conventional office landscaping arrangement, the bracket hook receiving slots 48 tend to give the end channel 24 a perforated appearance. To avoid this and thus to make the member 24 as well as the overall appearance more pleasing, a foam material 54 is glued to the rear of web 26 to extend between the post 14 and web 26 as shown. The foam may be black or color coordinated with the outer sheets 16.

In addition to serving as the sides for the frame 18 for each panel, each end channel member 24 secures the panel to support post 14. To this end, top and bottom clips 56 and 58 are secured to web 26 by rivets or similar means. The clips 56 and 58 engage upturned lips 60 and 62 at the top and bottom caps of support post 14 in a manner well known and conventional in the art. In the standard arrangement both the top and bottom clips 56 and 58 are securely and ridgedly fixed in place. This poses installation problems which may readily be appreciated when it is recalled that the panels are several feet in length and the clearance between the clips and lips are only a fraction of an inch. In accordance with a feature of the present invention, the lower clip 58 is loosely held by rivets 64 by virtue of the fact that the rivet holes 66 through clip 58 are slightly oversized. This arrangement permits the clip 58 to float. However, since the opposed surfaces 46 capture the clip and thus prevent horizontal movement the clip 58 is only free to shift vertically thereby providing some play to facilitate installation.

Thus, in accordance with the above, the aforementioned objectives are effectively obtained.

Having thus described the invention, what is claimed is:

1. An end channel for an area dividing panel adapted to receive a bracket hook of a given thickness, said channel comprising:

an elongated member;

a central web section of said member;

a pair of recesses integrally formed at a transverse end of said web section;

one of said rececces being defined by a pair of spaced apart surfaces extending perpendicular to said web section and a base extending parallel to said web section;

the other of said recesses being defined by a pair of surfaces spaced apart at a distance substantially equal to the thickness of a bracket hook and extending in parallel to said web; one of said surfaces comprising the base of said one recess and the other of said surfaces including a wing portion extending therefrom at an angle of 45° from the web in the direction opposite to that of said web and other recess; and a base for said other recess extending perpendicular to said web; and a plurality of bracket hook slots disposed in said other recess base.

2. The invention in accordance with claim 1, wherein said member is symmetrical about a longitudinally extending axis.

3. The invention in accordance with claim 1, further comprising hook means secured to the web at the longitudinal ends of said member and directed away from said one recess, at least one of said hook means being somewhat shiftable longitudinally.

* * * * *